US009284117B2

(12) United States Patent
Guild

(10) Patent No.: US 9,284,117 B2
(45) Date of Patent: Mar. 15, 2016

(54) CONVENIENT COVER OPENING AND CLOSING METHOD, SYSTEM, AND APPARATUS

(71) Applicant: Robert W. Guild, San Diego, CA (US)

(72) Inventor: Robert W. Guild, San Diego, CA (US)

( * ) Notice: Subject to any disclaimer, the term of this patent is extended or adjusted under 35 U.S.C. 154(b) by 0 days.

(21) Appl. No.: 14/340,827

(22) Filed: Jul. 25, 2014

(65) Prior Publication Data

US 2016/0023847 A1 Jan. 28, 2016

(51) Int. Cl.

| | |
|---|---|
| ***B65F 1/14*** | (2006.01) |
| ***E05D 13/00*** | (2006.01) |
| ***E05D 15/28*** | (2006.01) |
| *B65F 1/16* | (2006.01) |

(52) U.S. Cl.

CPC ..... *B65F 1/1623* (2013.01); *B65F 1/1646* (2013.01); *E05D 13/006* (2013.01); *E05D 15/28* (2013.01); *B65F 2001/1669* (2013.01)

(58) Field of Classification Search

CPC ..... B65F 1/1623; B65F 1/1646; E05F 1/10; E05F 1/1066; E05F 1/1075; E05F 1/1276; E05D 13/006; E05D 15/28

See application file for complete search history.

(56) References Cited

U.S. PATENT DOCUMENTS

| | | | | | |
|---|---|---|---|---|---|
| 2,888,162 | A * | 5/1959 | Herpich | B65F 1/1623 | 220/830 |
| 3,007,664 | A | 11/1961 | Fairbanks | | |
| 3,270,993 | A * | 9/1966 | Montague | 248/147 | |
| 4,290,352 | A * | 9/1981 | Schmidt et al. | 100/100 | |
| 4,545,523 | A * | 10/1985 | Galbreath et al. | 232/43.1 | |
| 4,655,357 | A * | 4/1987 | Hampton, Jr. | A01K 1/03 | 220/1.5 |
| 5,239,729 | A | 8/1993 | Scholl | | |
| 6,378,249 | B1 * | 4/2002 | Foss et al. | 49/386 | |
| 6,615,412 | B1 | 9/2003 | Hammond | | |
| 6,629,622 | B1 | 10/2003 | Abzaletdinov | | |
| 7,070,064 | B1 | 7/2006 | Henry | | |
| 7,083,060 | B2 * | 8/2006 | Pickler | 220/1.5 | |
| 7,357,271 | B2 * | 4/2008 | Hase et al. | 220/592.2 | |
| 8,418,869 | B2 | 4/2013 | Yang | | |
| 8,528,769 | B1 * | 9/2013 | McKenna | 220/263 | |
| 2001/0019097 | A1 * | 9/2001 | Schreyer | 248/291.1 | |
| 2009/0250463 | A1 | 10/2009 | Van Risseghem | | |
| 2011/0120997 | A1 | 5/2011 | Most | | |

OTHER PUBLICATIONS

PCT International Search Report, Jan. 7, 2016, 15 pages.

* cited by examiner

*Primary Examiner* — Katherine Mitchell
*Assistant Examiner* — Abe Massad
(74) *Attorney, Agent, or Firm* — San Diego Patent Prep & Pros, Inc.; Mary Fales

(57) ABSTRACT

A convenient cover opening and closing method, system, and apparatus are described. A cover grasper, adjustable tension, an anchor, and a stabilizer provide the necessary torques so that a cover opens and closes in a controlled smooth manner. Moreover, the apparatus and system may be conveniently removed from and secured to the cover's container, may be secured in a more permanent fashion to the container, or components of it may be secured on the container while others are not.

1 Claim, 19 Drawing Sheets

CONVENIENT COVER OPENING AND CLOSING METHOD, SYSTEM, AND APPARATUS

BACKGROUND

I. Field

The disclosed embodiments relate to a convenient cover opening and closing method, system, and apparatus.

II. Background

Some containers have covers that are inconvenient to open and close. For example, a standard refuse container has a large cover that is fairly heavy. A person is required to hold the cover up to open it, and the cover wants to slam shut if not held open. This requires a person to use one hand to awkwardly hold the cover open while placing items into and out of the container. Conversely, the cover wants to rotate all the way around and flop down towards the back of the container. If this happens, the cover has to be lifted and rotated all the way back to close it. This is inconvenient as well. Moreover, if a person has physical impairments, it may be extremely inconvenient to open and close a cover. Physical challenges can come from many aspects of life. For example, a war veteran may have lost a limb, or an elder may have debilitating arthritis. Typically, a person who has no physical challenges can use one arm to hold open the cover while placing the item(s) into a container, and this is inconvenient for them. However, a physically challenged person may not be able to do that. They may have use of only a single arm which would require them to put the item down, lift the cover, prop the cover open somehow, then grab the item again, place the item into the container, then close the cover. It also may take more time to place items into and out of the container if the container has a cover like this. Additionally, if the convenient cover opening and closing system is removable from the container, then that may be more convenient than a permanent opening and closing arrangement depending on the application. Therefore, there is a need in the art to provide a convenient cover opening and closing method, system, and apparatus.

SUMMARY

A convenient cover opening and closing apparatus and system are described. In an embodiment an apparatus for convenient cover opening and closing is disclosed that comprises: a cover grasper, wherein the cover grasper is configured to connect to a cover, an adjustable tension mechanism (ATM), wherein the ATM is configured to connect to the cover grasper and an anchor, an anchor, wherein the anchor is configured to connect to the ATM and provide a connection point for the ATM at a radial distance from the cover pivot point, and a stabilizer, wherein the stabilizer is configured to stabilize the anchor.

In yet another embodiment, an apparatus for convenient cover opening and closing is disclosed that, comprises: means for connecting to a cover, means for adjusting tension, wherein the tension connects to means for connecting to a cover, means for anchoring, wherein the means for anchoring comprises means for connecting to the tension at a radial distance from a cover pivot point, and means for stabilizing, wherein the means for anchoring is stabilized.

In another embodiment, an apparatus for convenient cover opening and closing is disclosed that, comprising: means for connecting temporarily and securely to a container, means for providing a limit stop that prevents the cover from rotating past 135 degrees, means for connecting to an adjustable tension mechanism (ATM), wherein the ATM connection point is at a radial distance from the cover pivot point, and means for stabilizing the means for connecting temporarily and securely to the container.

BRIEF DESCRIPTION OF THE DRAWINGS

The following embodiments may be better understood by referring to the following figures. The figures are presented for illustration purposes only, and are therefore not limiting.

DETAILED DESCRIPTION

Each of the additional features and teachings disclosed below can be utilized separately or in conjunction with other features and teachings to provide a convenient cover opening and closing method, system, and apparatus. Representative examples of the following embodiments, will now be described in further detail with reference to the attached drawings. This detailed description is merely intended to teach a person of skill in the art details for practicing the embodiments and is not intended to limit their scope.

The disclosed embodiments describe a convenient cover opening and closing method, system, and apparatus. An aspect of the convenience is demonstrated as follows: when a person slightly pushes up on a closed-cover the cover will slowly lift in a controlled smooth manner coming to an opening resting position. Likewise, when a person slightly pushes down on the open-cover to close it, the cover will slowly fall shut in a controlled and smooth manner. In some embodiments, the embodiments may be easily removable from the container facilitating further convenience. For example, on trash pickup days, the embodiments may be removed fairly quickly from a refuse container before placing the container out to the curb. When the container is empty, the embodiments may be fairly easily and quickly placed back onto the container for use. Some containers may not need to have the embodiments easily removable such as large commercial refuse containers or barbeque (grill) covers. In those types of applications, the embodiments may be more permanently attached to the container.

There are many applications for the various described embodiments. For example, the embodiments may be used on a barbeque grill cover, a garden refuse container, a compost container, commercial storage bins, household refuse containers, commercial refuse containers, live stock feed bins, and any container that has a cover that is inconvenient and would benefit from the use of a convenient cover opening and closing method, system, and apparatus as described. The various embodiments may now be explained in more detail starting with reference to FIG. 1.

Figure 1:
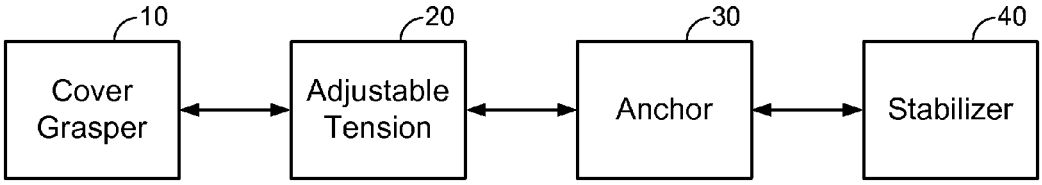
FIG. 1. illustrates a block diagram of the embodiment(s).

FIG. 1. illustrates a block diagram of the embodiment(s). In one embodiment, broadly speaking, there is a way of attaching to the cover. This may be called a cover grasper 10. It may be placed in various locations on the cover. This aspect may be called a cover grasper, cover connector, a connector, a connection point, or similar descriptive word/phrase.

In another embodiment, an anchor 30 may be broadly described. The anchor 30 may be attached to the container and provide a mount for some adjustable tension 20. The anchor 30 may also be not attached to the container, but elsewhere providing the same functionality. For example, the anchor 30 may be attached to a fence, wall, shelf, or shed. The anchor 30 may be called an adjustable tension mechanism (ATM) anchor, base, mount, or similar descriptive word/phrase.

In an embodiment, adjustable tension 20 is connected between the cover and the anchor 30 and provides adjustable tension. The adjustable tension 20 doesn't need to be exactly between the anchor 30 and the end of the cover. The adjustable tension 20 may be called a tension mechanism, force provider, an adjustable tension mechanism (ATM), force input mechanism, or similar descriptive word/phrase.

In another embodiment, stabilizer 40 is described. The stabilizer 40 may be connected to the anchor 30 and container and provide stabilization for the anchor 30. The stabilizer 40 may be not connected to the container, like the anchor 30, it may be attached elsewhere providing the same functionality. For example, the stabilizer 40 may be attached to a fence, wall, shelf, or shed. The stabilizer 40 may be an inherent part of the anchor 30 itself, an integral part of the anchor 30, or it may be a separate component attached to the anchor 30. The stabilizer 40 may be called an anchor stabilizing mechanism, an anchor stabilizer, a stabilizing mechanism, or similar descriptive word/phrase The various disclosed embodiments may be understood better in view of the following figures that are provided for illustration purposes. In order to explain the embodiments in a simplified manner, the application of a common household refuse container will be used as an example.

Figure 2A:
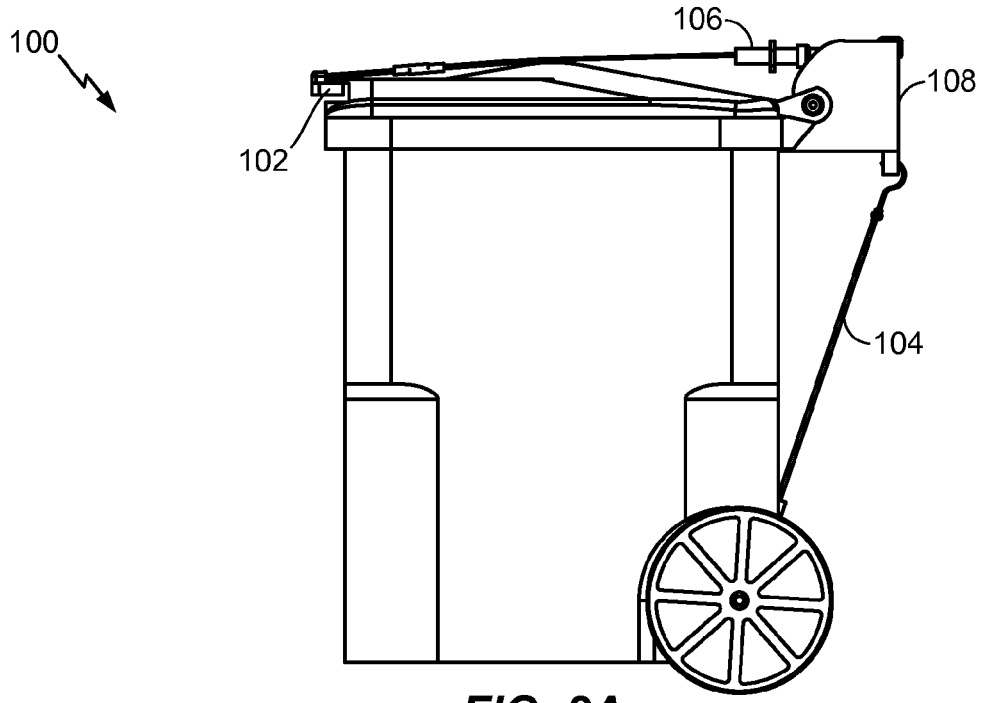
FIG. 2A. illustrates a closed-cover side view of the embodiment(s) that may be used on a refuse container.

FIG. 2A illustrates a closed-cover side view of the embodiment(s) 100 that may be used on a refuse container. A cover grasper 102 connects to the cover. In this embodiment the cover grasper 102 is shown as connected to the front center of the cover, but it doesn't have to be connected there. The cover grasper 102 may connect to an ATM 106. The cover grasper 102 may be any different number of mechanisms that perform the functions of connecting to the cover. For example, the cover grasper 102 shown here in this illustrative view is also shown in more detail in FIG. 7B. The cover grasper 702 demonstrates how an ATM 706 may be connected to it. The connection point for the ATM 706, may be a connector 707 as shown in FIG. 7B. For example, a connector 707 may be a simple eyebolt that facilitates ease of connecting and unconnecting to the ATM 106. The cover grasper 102 may be any mechanism that may connect the ATM 106 to the cover such as, but not limited to: an eyebolt, a bolt, a bolt snap hook, a fastener bolt, a twist tie, string, a hook, a screw bolt, mechanical connector, a clamp, a screw, a cover lip connector, clasp, refuse lid grasp, a wire, a connector, zip tie (or tie wrap), any combinations of these, or their equivalents. The cover grasper 102 may allow for the ATM 106 to be removable from the cover if necessary. In FIG. 2A the cover grasper 102 may be easily slid out from the cover lip 709, as shown in FIG. 7C, to allow the ATM 106 to be removed from the cover. Also, the connector 707 as shown, demonstrates that the ATM 106 may be removed from the cover grasper 702 by way of disconnecting the ATM 106 from the connector 707. In other words, some embodiments of the cover grasper 102 can be permanently or semi-permanently attached to a cover and/or an ATM while other embodiments may be temporarily secured to the cover and/or ATM. More examples of the cover grasper 102 will be described below in more detail.

The ATM 106 may be many various mechanisms that provide the function of adjustable tension and connect between the cover and the ATM anchor 108. The ATM 106 broadly speaking produces an upward torque force on the cover. The ATM 106 may be, but not limited to: a simple bungee cord, an adjustable bungee strap, a spring, an adjustable spring, a hydraulic cylinder, a pneumatic cylinder, a sash weight, an electronically controlled adjustable tension, any combinations of these, or their equivalents. In an embodiment, the ATM 106 is adjusted via an electrical component. For example, a programmable arrangement of circuitry that can mechanically adjust the tension of the ATM 106 based on input from a user, or based on an automatic response to programming, or based on feedback from the ATM 106 itself may be used. Other embodiments of the ATM 106 and its function(s) will be described below in more detail.

The ATM anchor 108 provides a connection point at a radial distance from the pivot point for the ATM 106. In other words, where the ATM 106 connects to the anchor 108 is away from the pivot point (hinge) of the cover. For example, the ATM 106 may connect to the anchor 108 at a distance directly above the pivot point (hinge). As shown here in FIG. 2A, the ATM 106 is connected to the anchor 108 at a distance outboard from the pivot point. The ATM anchor 108 may be semi-permanent, permanent, or removably secured to the container. The ATM anchor 108 is also illustrated as anchor 300 in more detail in FIG. 3. The ATM anchor 108 may be cheaply manufactured with molded plastic(s), metal(s), wood (s), or various combinations of these, or any other suitable material(s). The ATM anchor 108 may be implemented such that it is secure and won't rotate or move around on the container (or an off-container mount) too much when in use. An anchor stabilizing mechanism 104 may help provide this function. In some embodiments, the anchor stabilizing mechanism 104 is a separate component from the ATM anchor 108, a connected component, or an inherent part of the ATM anchor 108.

Figure 5:
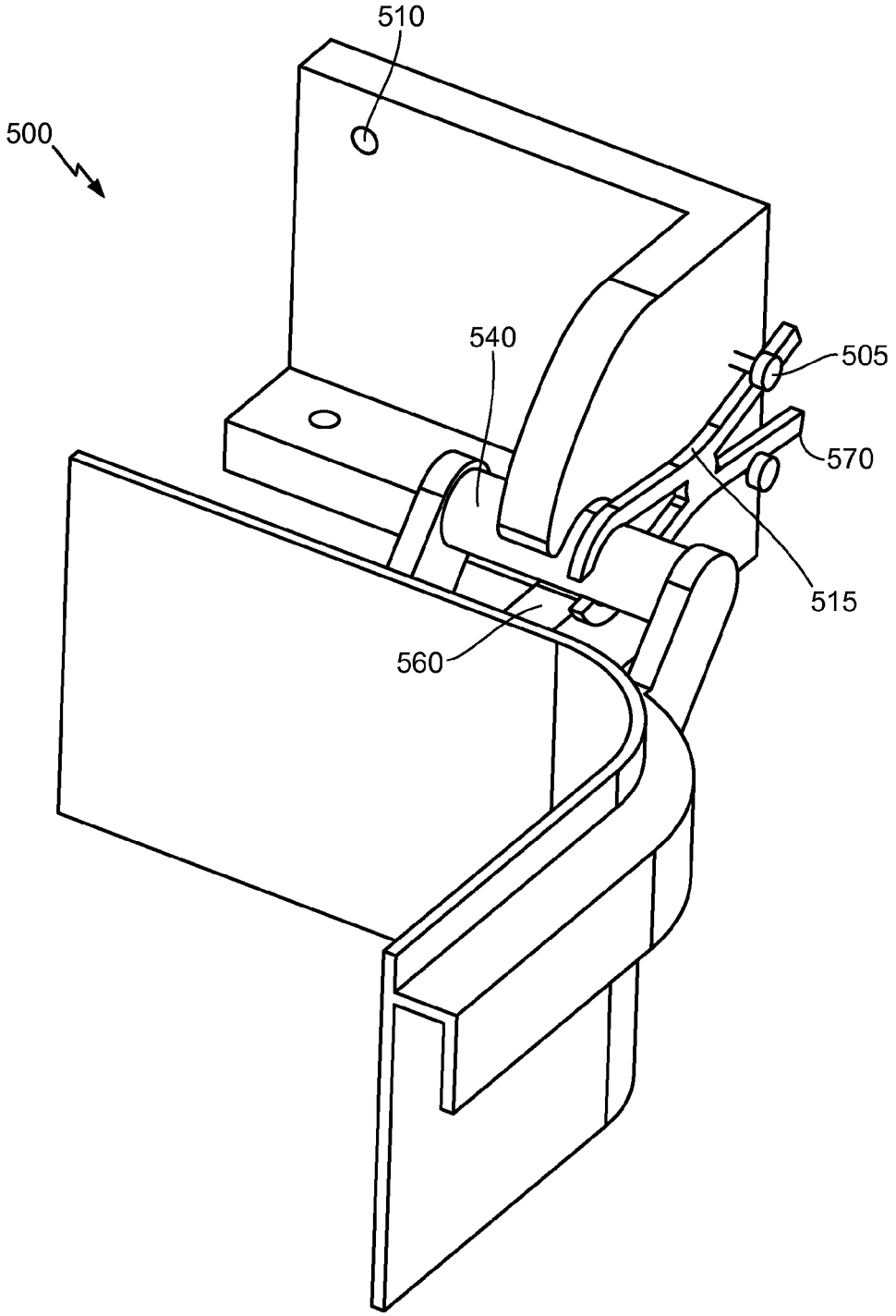
FIG. 5. illustrates a cut-away view of an embodiment(s) demonstrating an anchor stabilizer embodiment.

The anchor stabilizing mechanism 104 as shown here may be connected to the ATM anchor 108 and to the container. The anchor stabilizing mechanism 104 may be connected down below on the container bar as shown here in FIG. 2A. The anchor stabilizing mechanism 104 may be attached elsewhere and not connected to the container as well. The ATM anchor 108 may provide a substantially consistent point for the ATM 106 to attach to that is at a radial distance from the cover's pivot point. The anchor stabilizing mechanism 104 may be many various mechanisms that perform the function of providing stabilization to the ATM anchor 108 to prevent the ATM anchor 108 from rotating or moving too much while in use. The anchor stabilizing mechanism 104 shown in FIG. 2A is also shown in more detail in FIG. 10B as stabilizer 1015. In this embodiment the stabilizer 1015 may be a simple mechanism that hooks 1020 onto the container bar. The hook 1020 may be shaped (not shown here) like an upside down question mark such that the connection to the container isn't necessarily a result of the hook hooking on the bar, but from the tension pulling between the hook's top and the container. The stabilizer 1015 may be conveniently shaped to allow a person to not have to bend over much to disconnect it from a container bar. For example, it may be a long stiff like pole that a user can reach the top of the pole and disconnect the stabilizer 1015 without having to bend down to the bar. In other embodiments the anchor stabilizer 515 as shown in FIG. 5 may be connected to the container handles. In other words many various mechanism would be able to perform the function of the anchor stabilizing mechanism 104. The anchor stabilizing mechanism 104 may be part of the ATM anchor 108 itself, an integral part of the ATM anchor 108, or a separate component. For example, the ATM anchor 108 may be manufactured to be heavy enough not to rotate while in use, thus, the anchor stabilizing mechanism 104 is an inherent part of the ATM anchor 108.

FIG. 2A illustrates how the embodiments may look when the cover is closed and resting shut. In contrast, FIG. 2B illustrates an open-cover side view of the embodiment(s) 100 that may be used on a refuse container. As demonstrated in FIG. 2B, the embodiments may provide a cover-open resting point (e.g. a limit stop) to prevent the cover from falling down towards the back of the container.

Figure 2C:
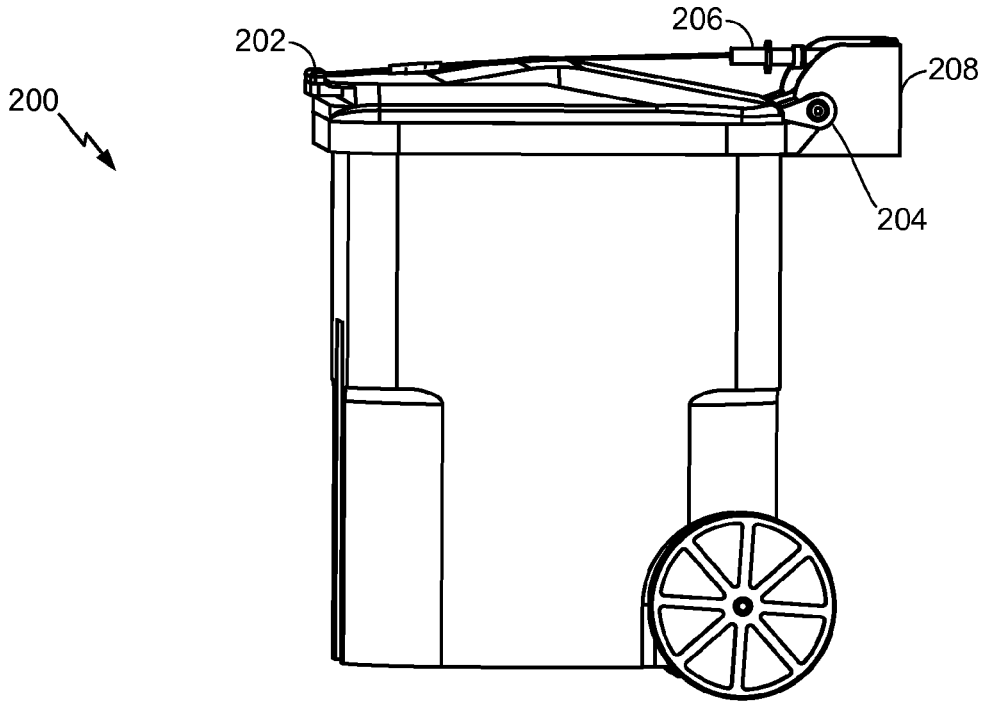
FIG. 2C. illustrates a closed-cover side view of other embodiment(s) that may be used on a refuse container.
Figure 2B:
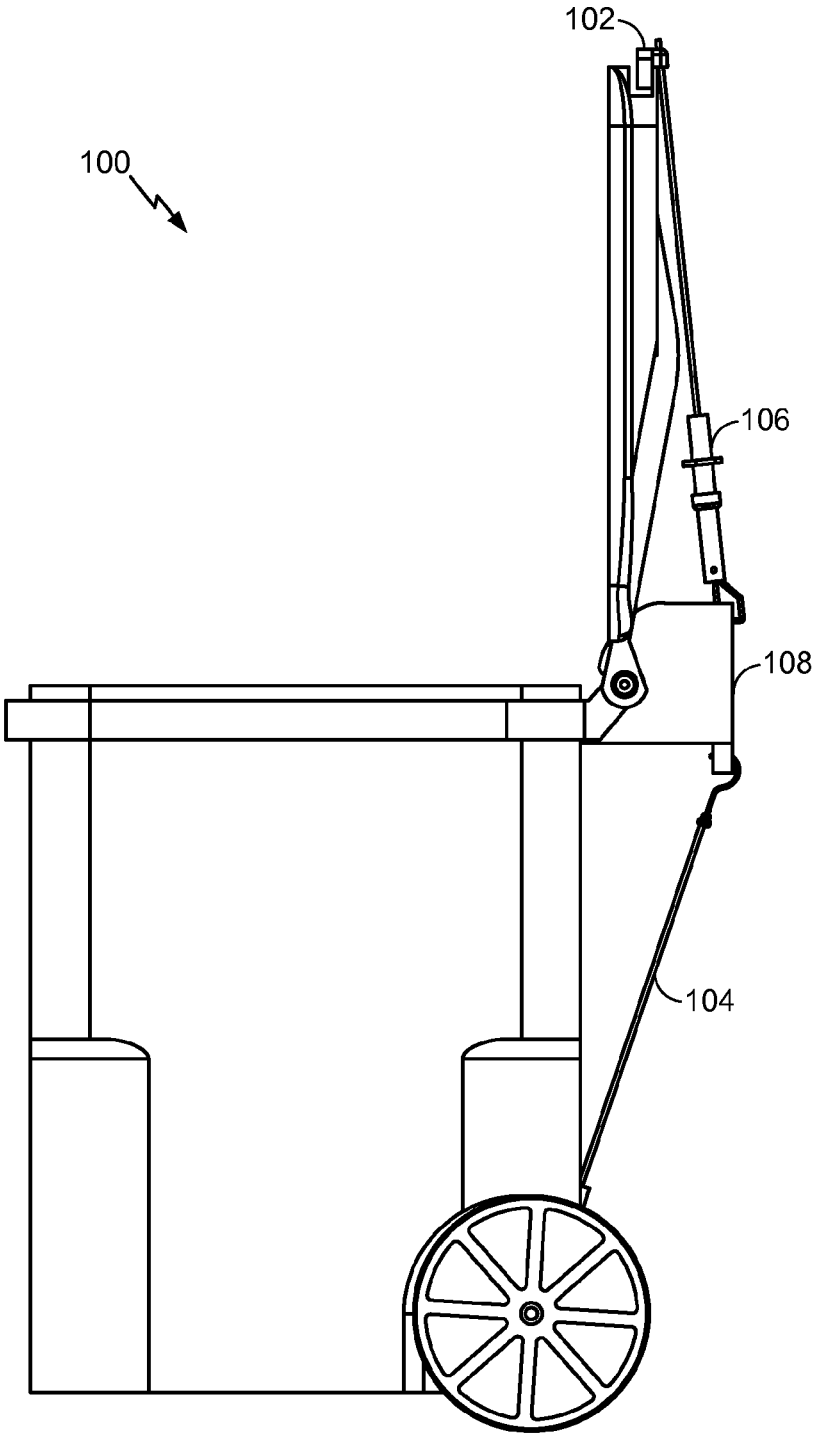
FIG. 2B. illustrates an open-cover side view of the embodiment(s) that may be used on a refuse container.

FIG. 2C illustrates a closed-cover side view of other embodiment(s) 200 that may be used on a refuse container. In some embodiments the anchor stabilizer 204 may be connected to the container in the general area where the anchor 208 is connected. A force provider 206 attaches to the anchor 208 and a cover connector 202. The anchor stabilizer 204 may be an inherent part of the anchor 208, or closely coupled with it. For example, the anchor stabilizer 204 may be a finger release clamping mechanism that connects to the anchor 208 and to the container to provide stability. An example of this embodiment is shown in FIG. 5 as stabilizer 515. Various combinations of the disclosed embodiments may be utilized to provide a convenient cover opening and closing method, system, and apparatus. It should be clear to one of skill in the art that the disclosed embodiments are various, may be combined in variety of manners, and are much broader than the figures show. Now that the main components are generally described, a more detailed discussion of how the embodiments work to accomplish the convenient cover opening and closing method, system, and apparatus will be provided.

Figure 13:
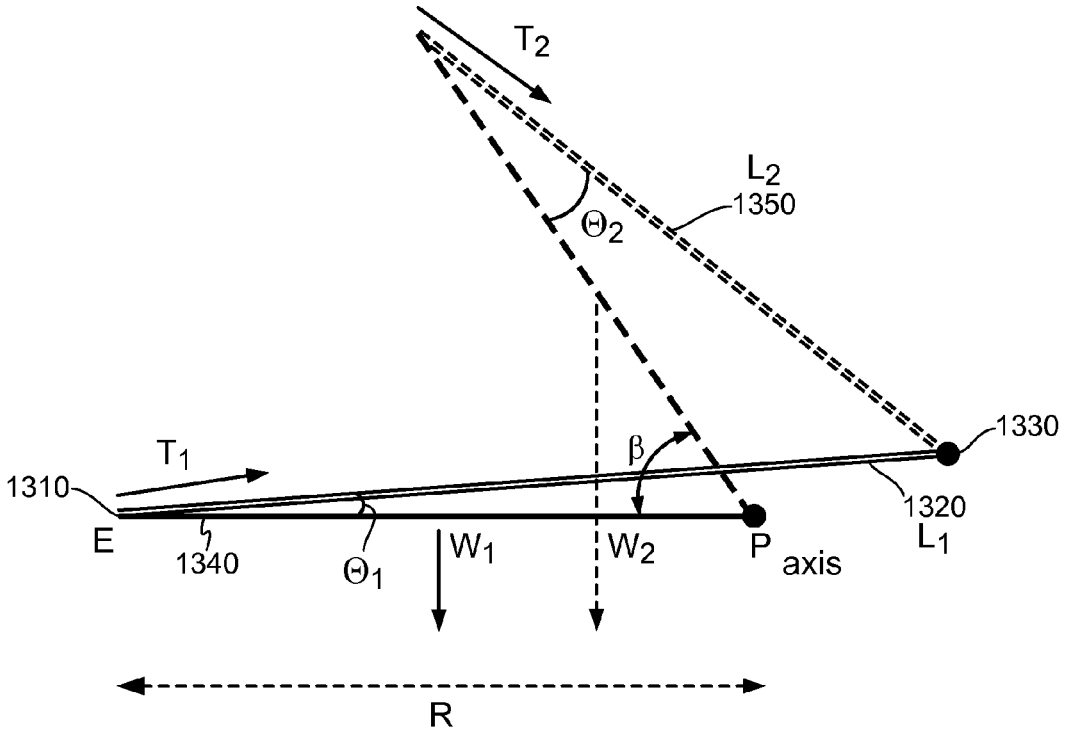
FIG. 13. illustrates a simplified free body diagram illustrating some of the physical aspects of an embodiment.

FIG. 13. illustrates a simplified free body diagram illustrating some of the physical aspects of an embodiment. A cover, can be considered a lever arm 1340 and has a center of mass approximately in the center of the cover as noted by the point labeled "$W_1$." Wherein "$W_1$" represents the total downward force of the cover in newtons (N). A cover, like the one illustrated in FIG. 2A, has some total weight W associated with it. For example, a typically household refuse cover may weight between 3-5 lbs. If a cover of this weight accidently falls on a person's arm or hand it may hurt them. Also, a cover like this may be heavy to lift and hold up. When the cover is closed, the forces pushing down on the cover are equal to the forces pushing up on the cover. This may be described as, the cover in equilibrium. In equilibrium, the cover isn't moving up or down.

The hinge where the lever arm 1340 rotates up and down on the container is called a pivot point. In FIG. 13 this point is labeled as "$P_{axis}$". When there is a pivot point or a fulcrum the lever arm movement may be describe in terms of torque. When torque is applied to a lever arm 1340 it will produce angular acceleration. For example, if you have a pinwheel that isn't rotating (not spinning), and you apply torque to it (blow on the pinwheel blades), the pinwheel will spin (angular acceleration). The pinwheel if not spinning is considered to be in rotational equilibrium (not spinning). Conversely, a pinwheel that is spinning at the same rate, not spinning faster or slower, is in rotational equilibrium. We can describe this equilibrium state as saying that the net torque is zero. Torque is defined as the cross product of the lever-arm distance vector and the force vector. In other words, how much torque depends on how far away the force applied is from the pivot point and how much force is applied. The force component that produces rotation is the force that is perpendicular to the lever-arm (or rotational arm). So if a force isn't exactly perpendicular (at 90°) to the lever-arm, then we want to solve for the force component that is. We can express this mathematically as:

$$\tau = r \cdot F\perp \qquad \text{Equation 1.)}$$

Where $\tau$ is torque in units of Nm;

r is the distance in meters from the pivot point to the point where the force is applied; and $F\perp$ is the perpendicular force applied in newtons.

Since the force that produces torque is the force that is perpendicular to the lever-arm, any force that passes through the center of rotation will not produce torque. For example, if you push on the end of a wrench (lever-arm) towards the bolt (pivot point) it will not turn. This is because the force applied isn't perpendicular to the wrench. In other words, the force is parallel to the lever-arm and not producing any torque. The magnitude of the cross products of $|r \cdot F| = |F \cdot r|$, thus, the equation may be rewritten as:

$$\tau = r\perp \cdot F \qquad \text{Equation 2.)}$$

Where $\tau$ is torque in units of Nm;

$r\perp$ is the perpendicular distance in meters from the pivot point to the line of action where the force is applied; and F is force applied in newtons.

Depending on where the angle is in relation to the line of action, the expression may be solved as:

$$\tau = r \sin(\Theta) \cdot F, \text{ or as, } \tau = r \cos(\beta) \cdot F \qquad \text{Equations 3.)}$$

Where $\tau$ is torque in units of Nm;

r is distance in meters from the pivot point to the point where the force is applied;

where sin ($\Theta$) is the length of the opposite side of a right triangle divided by the length of the hypotenuse;

wherein cos($\beta$) is the length of the adjacent side of a right triangle divided by the length of the hypotenuse; and F is the force applied in newtons.

Referring back to FIG.13, if the lever-arm 1340 is at rest and closed, the net torque is zero, or the downward torque is equal to the upward torque. The downward torque $W_1$ may be expressed as $W \cdot (r/2)$, wherein W is the total downward weight in newtons (N) and r is the distance in meters (m) between where the downward force is applied (r/2) and the pivot point $P_{axis}$. Here, in a closed-cover position, all of the force W applied is perpendicular to the lever-arm. The upward torque can be expressed as $r\perp\cdot T$, where $r\perp$ is equal to r (sinΘ), and T is the tension force in newtons. Thus, for the net torque to be zero, $|r(\sin\Theta)\cdot=|W\cdot(r/2)|$. In FIG.13 it can be seen that the torques, both downward and upward, will vary and change as the lever arm rotates. The disclosed embodiments control the torques such that the cover lid will slowly and smoothly rotate upwards (e.g. in a controlled manner) when a person slightly pushes on the cover, and slowly and smoothly rotate downwards (e.g. in a controlled manner) when a person slightly pushes on the cover to shut it.

As mentioned previously, the ATM 106 provides upward force, or upward torque force. Without the ATM 106 a person slightly pushing up on the cover, for example, at the point labeled E 1310, would produce some torque that in turn produces angular acceleration. However, the opposing torque from the weight of the cover is greater than the person produced torque and the cover comes falling down quickly and closes shut. When a cover has an ATM 106 as described in conjunction with the cover grasper 102, the ATM anchor 108, and the anchor stabilizing mechanism 104, it provides the necessary torque to achieve a convenient cover opening and closing method, system, and apparatus.

The ATM 106 provides tension. When the cover is closed and resting flat, the ATM 106 basically provides mostly horizontal force on the cover between the cover end and the cover fulcrum point. This may be expressed in FIG. 13 as $T_1$. Some torque force may be present, but is negligible and can't overcome the inertia (downward torque forces) of the closed-cover. In other words, the ATM 106 in the closed-cover position isn't providing significant upward force that is perpendicular to the lever-arm (cover). However, with an ATM 106, when a person pushes slightly upwards on the cover, for example at point 1310, it is enough to overcome the resting inertia and the ATM 106 will produce an upward torque force that is greater than the downward torque force and will rotate the cover upwards. As the cover rotates upwards the torques will change.

The ATM anchor's 108 position 1330 away from (e.g. at a radial distance that is outboard from the pivot point) the pivot point $P_{axis}$ helps to achieve this. The ATM 106 connection point to the ATM anchor 108, by being placed away 1330 from the pivot point $P_{axis}$, enables the angle (theta Θ) to change as the cover rotates. FIG. 13 helps illustrates this. The angle $\Theta_1$ when the cover is closed is small compared to the $\Theta_2$ when the cover is moving upwards. Mathematically, $\tau=r\sin(\Theta)\cdot T$. Thus, it is apparent that the smaller the angle Θ is, the less upward torque (τ) will be applied to the cover. Referring to FIG. 13, it can be seen that $\Theta_2$ is larger than $\Theta_1$. Thus, the upward torque resulting from the angle theta changing, is less when the cover is closing, and greater when the cover is opening. In conjunction, the position of the ATM anchor 108 being placed away (e.g. at a radial distance) 1330 from the pivot point $P_{axis}$ also changes the tension in the ATM 106 as it rotates.

FIG. 13 helps illustrate this effect. As shown in FIG. 13, $L_1$ 1320 is the total length of the ATM 106 when it is in a closed-cover position. As the cover rotates upwards, the length shortens and is shown as 1350 $L_2$. The ATM 106 providing tension, may be expressed in terms of a spring as:

$$T=kx \qquad \text{Equation 4.)}$$

Where T is the tension in newtons (N);

k is a constant associated with the spring in N/m; and x is the length in meters (m) that the spring extends past its resting state.

Thus, when the cover is closed and the ATM 106 is at length 1320 $L_1$, the tension $T_1$ is greater than $T_2$, because $L_2$ is$<L_1$; the length (x) is extended past the resting state of the spring more in $L_1$ than in $L_2$. As the cover rotates upwards, the ATM anchor 108, by not moving the point where the ATM 106 attaches to it, allows the length of the spring to shorten ($L_2$) reducing the tension shown as $T_2$.

Moreover, The downward torque will vary as the cover rotates up and down as well. The downward torque labeled $W_1$ is greater than the downward torque $W_2$ as the cover rotates up. As one can see from the diagram, for $W_2$, the distance from the pivot point $P_{axis}$ is less than r/2 as the cover rotates up. $W_2$ may be expressed as: $W_2=|W\cdot r/2\cos(\beta)|$, wherein beta β is shown in FIG. 13, and cos (β) is the length of the adjacent side of a right triangle divided by the length of the hypotenuse. Thus, $W_2$ is less than $W_1$, wherein $W_1=|W\cdot r/2|$. Therefore, it is apparent to one of skill in the art that the net effects of the forces working together produces a controlled smooth lifting and lowering action. Referring back to FIG. 2*a*.

The tension in the ATM 106 may be adjusting as the lever arm rotates. Moreover, the tension in the ATM 106 may be preset or adjusted to a specific cover for operation before use. In an embodiment, the ATM 106 may be specifically calibrated with the correct tension for a given cover and not need to be independently adjusted. For example, an ATM 106 may be provided off the shelf that is pre-calibrated to work with a standardized refuse container cover. In other embodiments, the ATM 106 is adjustable, and may be adjusted by a user, to work with the specific cover it is used on. In yet another embodiment, the ATM 106 may be both pre-adjusted to work on a specific cover, and also adjustable while being used on a cover. This "in-use" adjustability may be associated with the ATM 106 tension changing as the cover rotates, and/or the ATM's 106 user adjustable feature. It should be clear to one of skill in the art, that the tension from the ATM 106 has to be adjusted for the type of cover, because the length and weight of the covers will vary. Moreover, some springs change over time and it may be desirable to have an ATM 106 that can be adjusted if that occurs. For example, a spring's constant k, may change over time.

Referring to FIG. 2B, in an embodiment the ATM anchor 108 not only provides for a point for the ATM 106 to connect between the cover and at a radial distance from the pivot point, but it may also provide for a travel limit stop for the cover. It may provide a physical barrier to prevent the cover from flying all the way around, for example, stop the cover approximately between 90°-112° degrees in an open position. This open-cover stop position is demonstrated in FIG. 2B.

Figure 3:
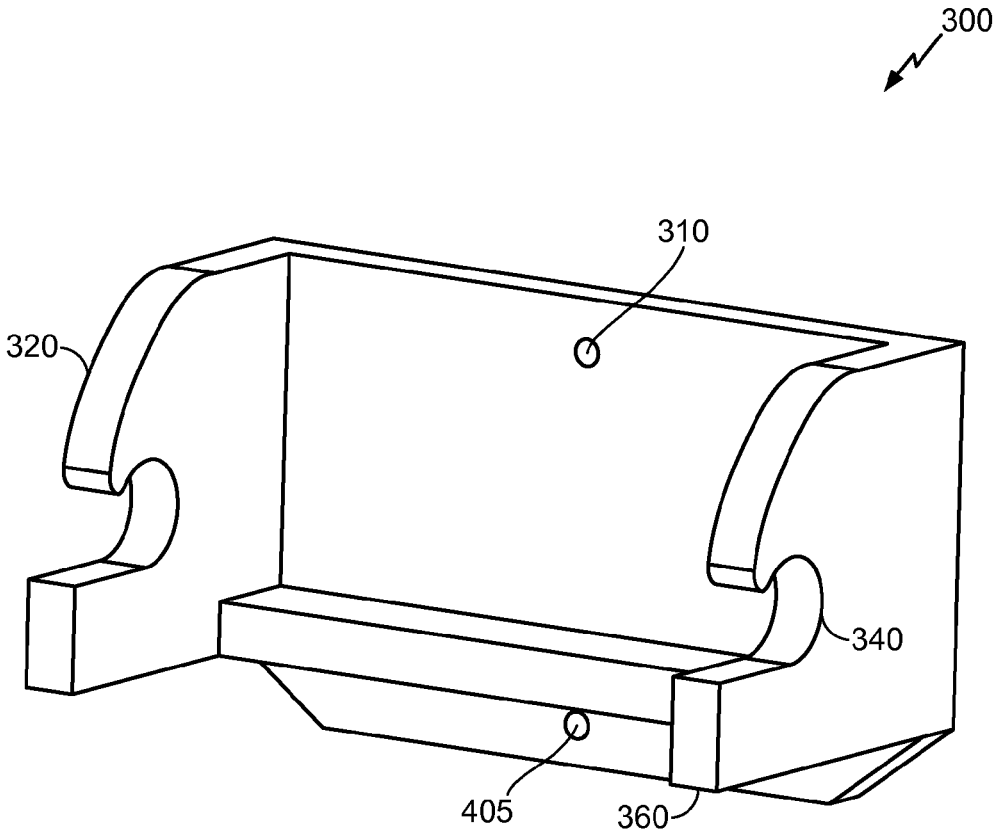
FIG. 3. illustrates an example embodiment of an easy to remove and secure ATM anchor.
Figure 4:
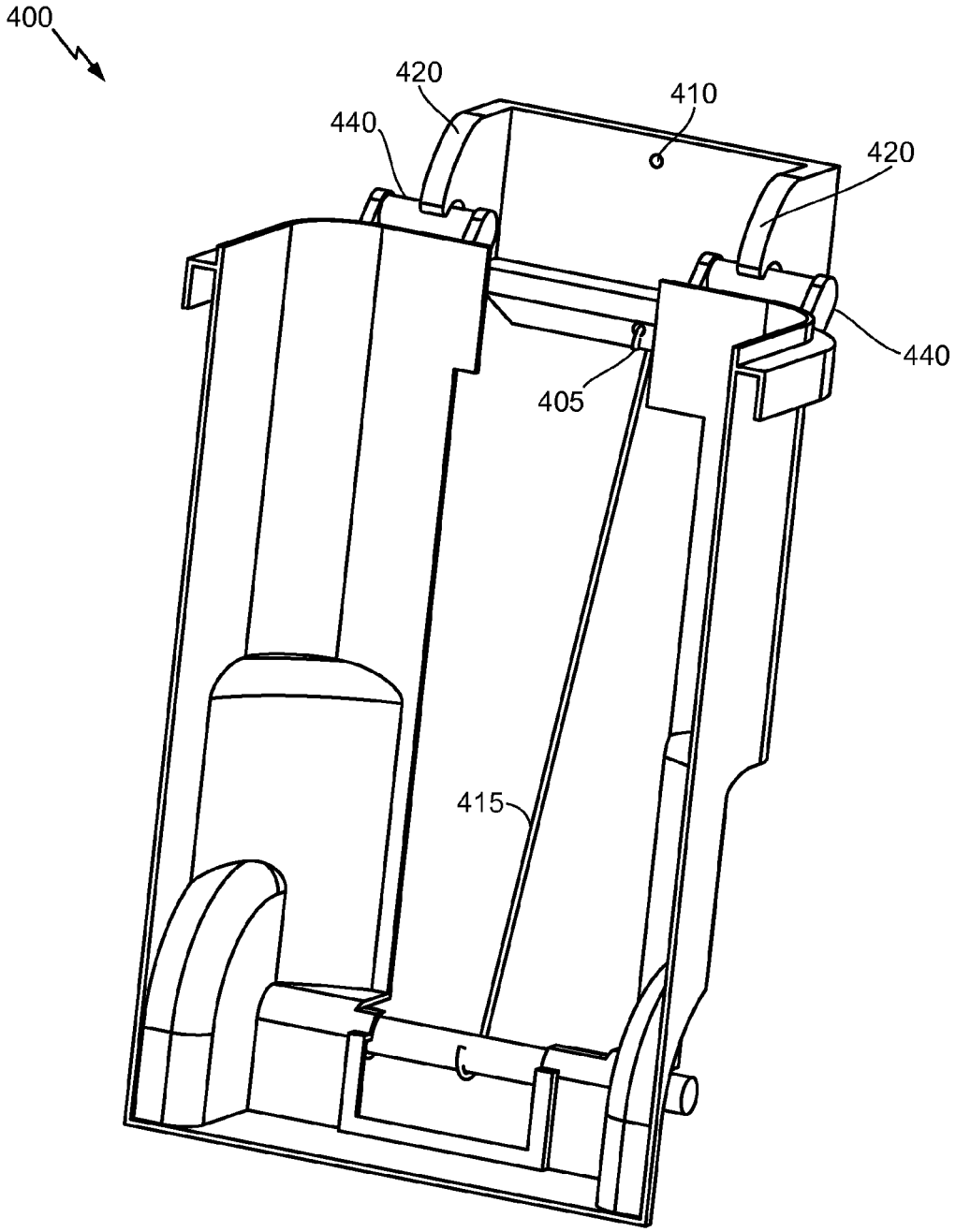
FIG. 4. illustrates a cut-away view of the embodiment(s) that may be used on a refuse container.

In another embodiment, the ATM anchor 108 may be designed to be removably secured to a container. Removable means it is not permanent and can be taken on and off the container (or wall etc.). Secured means when it is on the container it is secure and won't come off during operation unless desired to be removed. FIG. 3 illustrates an example embodiment of an easy to remove and secure anchor 300. The anchor 300 comprises a means for attaching to a container that is removably secure. Attaching mechanism 340 as shown here may be a type of hook (or set of hooks) that hooks onto the container's handles as shown in FIG. 4. The attaching mechanism 340 allow for the anchor 300 to be placed securely onto the container, and also for the anchor 300 to be removed from the container. Since, the ATM 106 is under some tension even if low, and the anchor stabilizer 104 may be under some tension as well, the anchor 300 may be placed on first then have the ATM 106 and the anchor stabilizer 104 secured afterwards. And to remove the anchor 300 the reverse order may be done.

In an embodiment, the anchor 300 may comprise physical barriers 320 that stop the cover when it is open from rotating all the way around and falling to the back of the container. The anchor 300 may comprise a connection mechanism 310 that allows the ATM 106 to connect to the anchor 300. This connection mechanism 310 point is illustrated as 1330 in FIG. 13. The anchor 300 may comprise another connection 405 that allows for an anchor stabilizer 104 to connect to. The anchor 300 may comprise a clock-wise rotational stabilizing component 360 that prevents the anchor from rotating clockwise when in operation. The connections 310 and 405 may be placed in a variety of positions without effecting the functionality and operation of the convenient cover opening and closing method, system, and apparatus.

FIG. 4 illustrates a cutaway view of the embodiment(s) 400 that may be used on a refuse container. In this example, anchor 300, is shown removably secured 420 to the container handles 440. The stabilizer 415 is shown connecting to the anchor at connector 405 and to the bottom bar of the container. The stabilizer 415 may prevent the anchor 300 from rotating in a counter-clockwise direction. Conversely, stabilizing component 360 prevents the anchor from rotating in a clock-wise direction. Thus, the stabilizer 40 may comprise either or both of a clockwise and counter-clockwise component(s). Additionally, a connector 410 is shown where the ATM 106 may connect to the anchor 300.

FIG. 5 illustrates a cut-away view of an embodiment(s) 500 demonstrating an anchor stabilizer embodiment. In an embodiment, the anchor 30 may be stabilized with an anchor stabilizer 515 that is an integral part of the anchor 30. For example, anchor stabilizer 515 may be in the form of a clamping mechanism 570 that may clamp to the container handles 540. The anchor stabilizer may be connected 505 to the anchor 30. A stabilizing component 560 may prevent the anchor 30 from rotating in a clock-wise direction. A connector 510 allows for the ATM 106 to connect to the anchor 30. In this embodiment, an example of an anchor stabilizer 515 that isn't an inherent part of the anchor 30 itself or a separate part of the anchor 30, but a connected integral part of the anchor 30 is shown.

Figure 6:
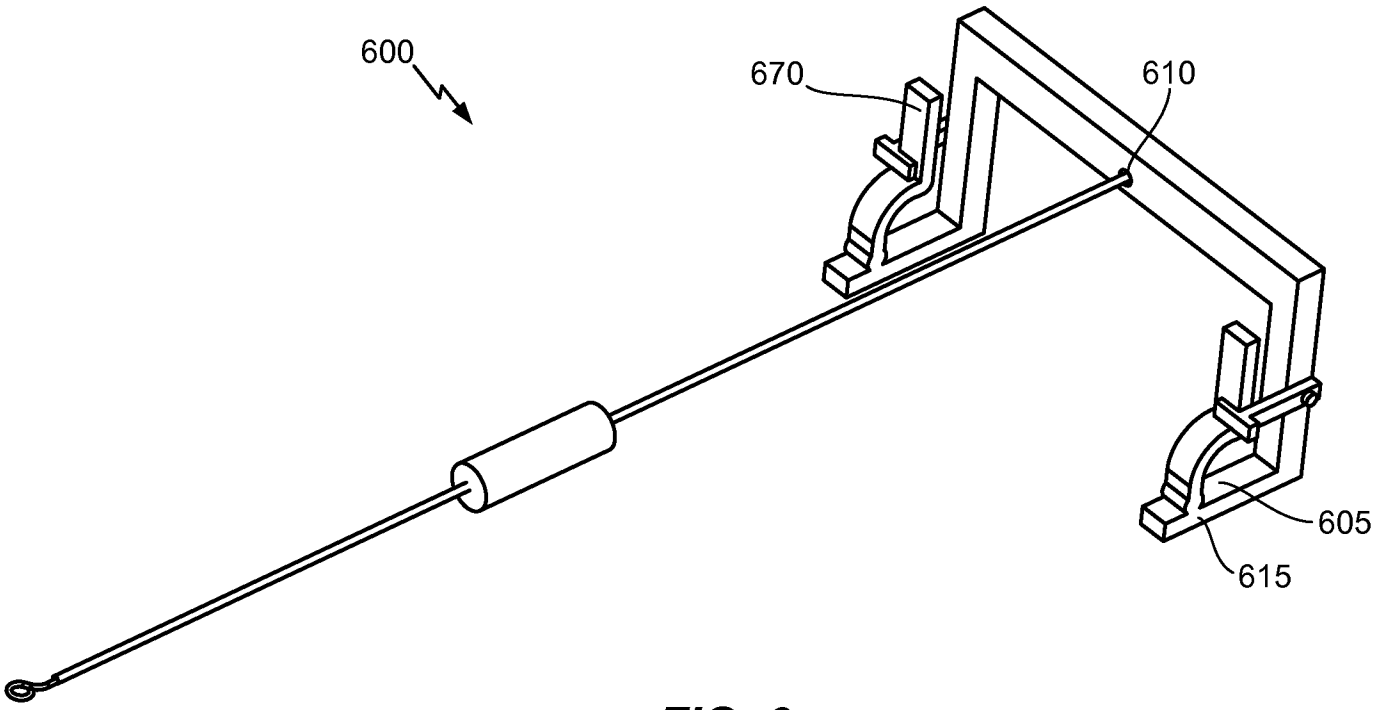
FIG. 6. illustrates other embodiment(s) demonstrating an anchor embodiment.

FIG. 6 illustrates other embodiment(s) 600 demonstrating an anchor embodiment. In an embodiment the anchor 30 may be stabilized with a stabilizer 615 that is in the form of a clamping mechanism 670 that may clamp to the container handles 440. In this embodiment, the connection point 610 provides for point where the adjustable tension 20 may be connected to the anchor 30. The anchor 30 in this embodiment is more integrated with the other embodiments. For example, the stabilizer 615 is integrated more into the shape and design of the anchor 30. Also, the cover stop (limit stop, travel limit, physical barrier, etc.) may be part of the "U" shaped bar in that the bar will prevent the cover from rotating past 135 degrees. Thus, the connection 605 between the stabilizer 615 and the anchor 30 is somewhat seamless. In this embodiment, the stabilizer 615 may be considered an inherent part of the anchor 30. In another embodiment, the weight of the anchor alone may provide for the inherent stabilizing component. Moreover, if the anchor 30 is attached off the container, like for example, as an eyebolt on a fence, then the stabilizer 40 would be an inherent part of the anchor 30.

Figure 7A:
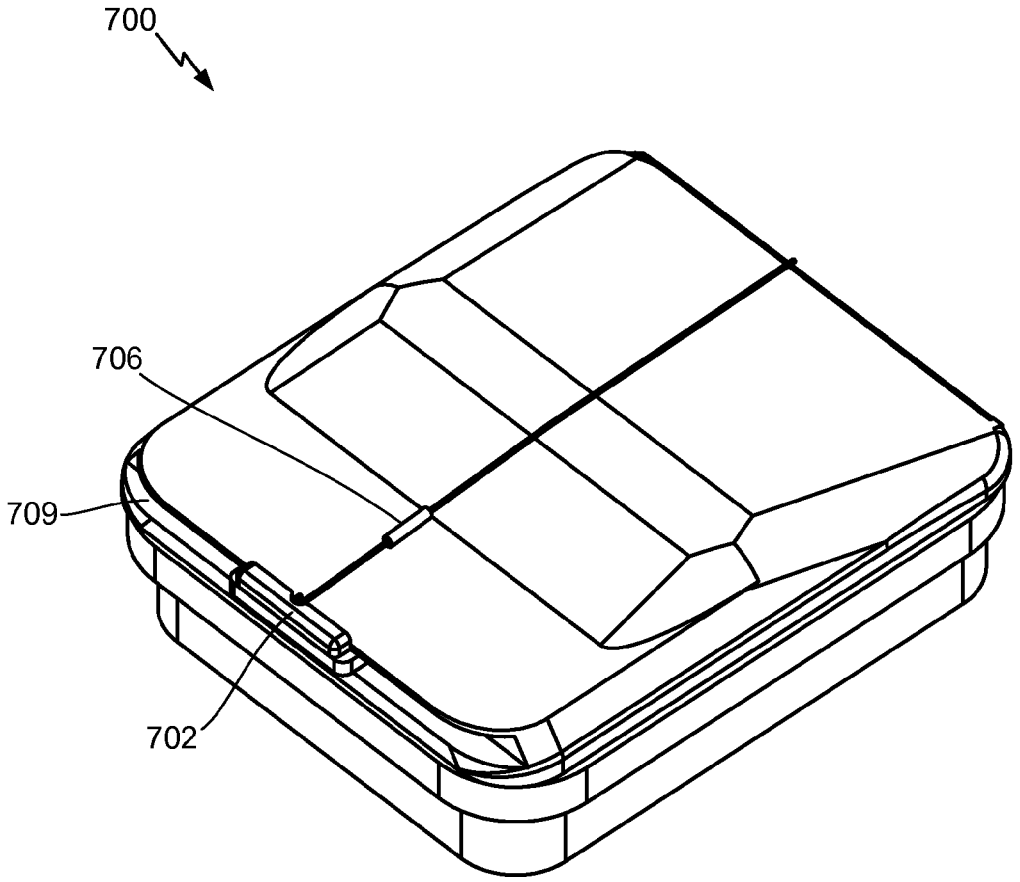
FIG. 7A. illustrates embodiment(s) demonstrating a cover connector embodiment.
Figure 7B:
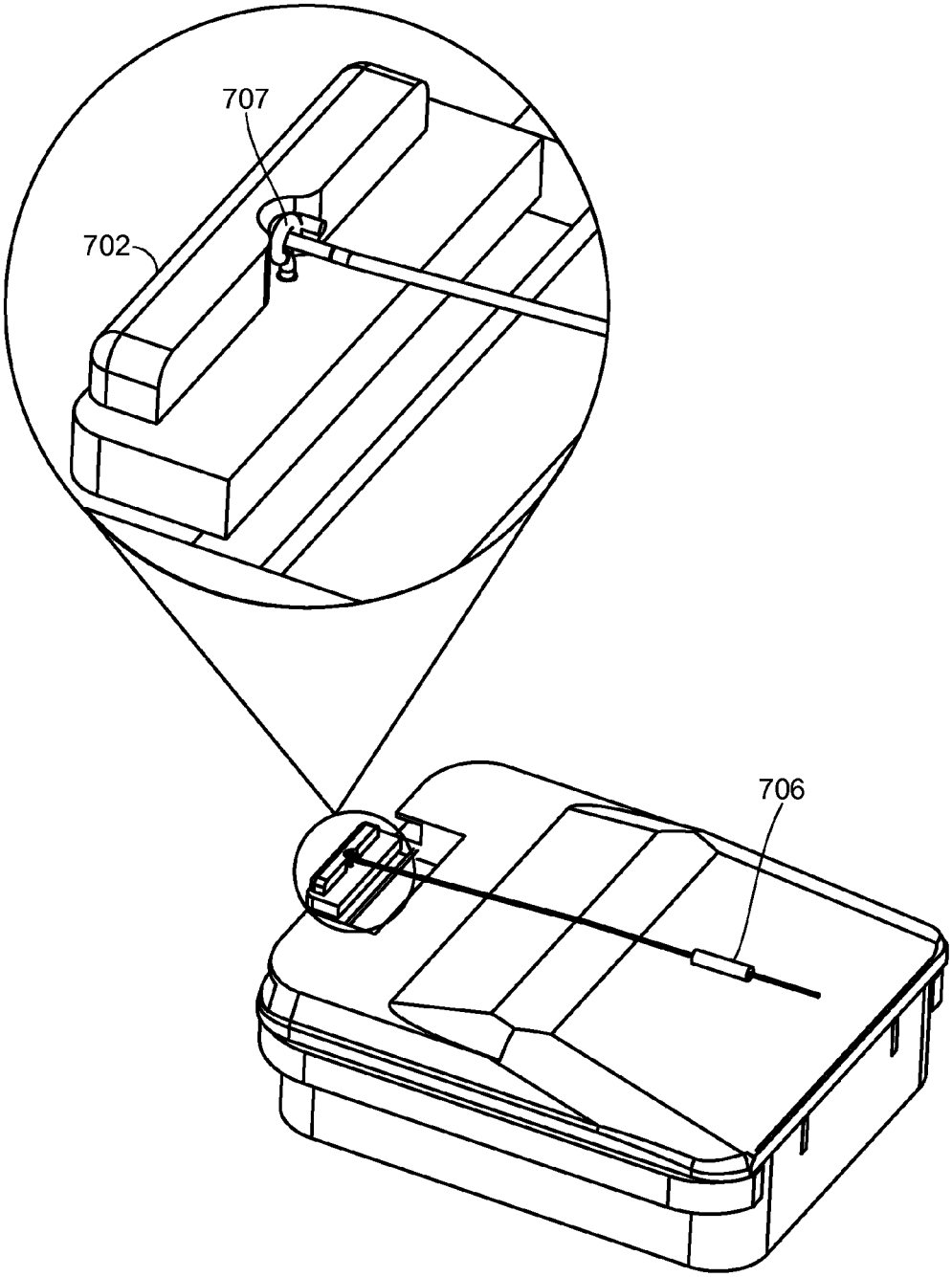
FIG. 7B. illustrates a cut-away view of a cover connector embodiment.
Figure 7C:
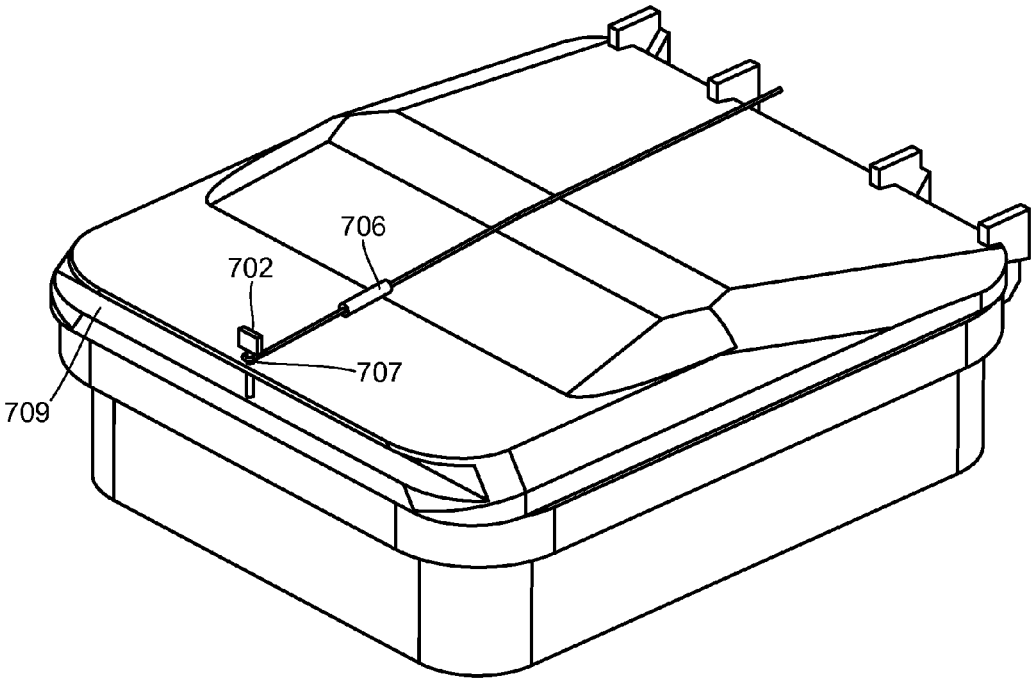
FIG. 7C. illustrates other embodiment(s) demonstrating a cover connector embodiment.
Figure 7D:
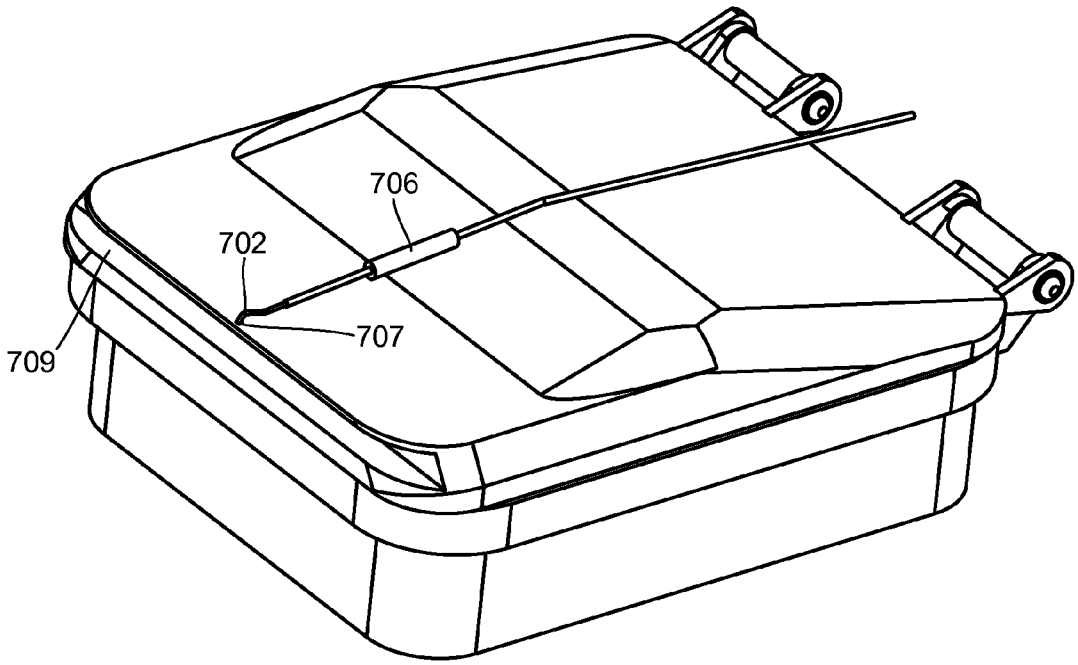
FIG. 7D. illustrates another embodiment demonstrating a cover connector embodiment.

FIG. 7A. illustrates embodiment(s) 700 demonstrating a cover connector embodiment. In this embodiment, a cover grasper 702 is shown. The cover grasper 702 may be a device designed to slide under and out of the cover lip 709. The adjustable tension 20 is connected to the cover grasper 702. FIG. 7B. illustrates a cut-away view of a cover connector embodiment. In this view, cover grasper 702 is shown in a cut away view providing more detail. The connection point 707 for the adjustable tension 20 is demonstrated as an eyebolt, but any permanent or removable connection may be used. FIG. 7C. illustrates other embodiment(s) demonstrating a cover connector embodiment. In this embodiment, it may be seen that the cover grasper 10, may be something as simple as a fastener bolt that is attached to the cover. The adjustable tension 20 can connect and disconnect from it. FIG. 7D. illustrates another embodiment demonstrating a cover connector embodiment. In this embodiment, the cover grasper 10 is an inherent part of the adjustable tension mechanism 706. The cover grasper 702 may be something as simple as a hook attached to a bungee cord. Here the connection point 707 may be something as simple as a hole drilled into the cover where the hook may connect to the cover. It should be apparent to one of skill in the art that any number of combinations of cover graspers may be used that achieve the same purpose, and that the cover grasper may be temporal attached in a variety of manners to the cover and adjustable tension 20 as well.

Figure 8A:
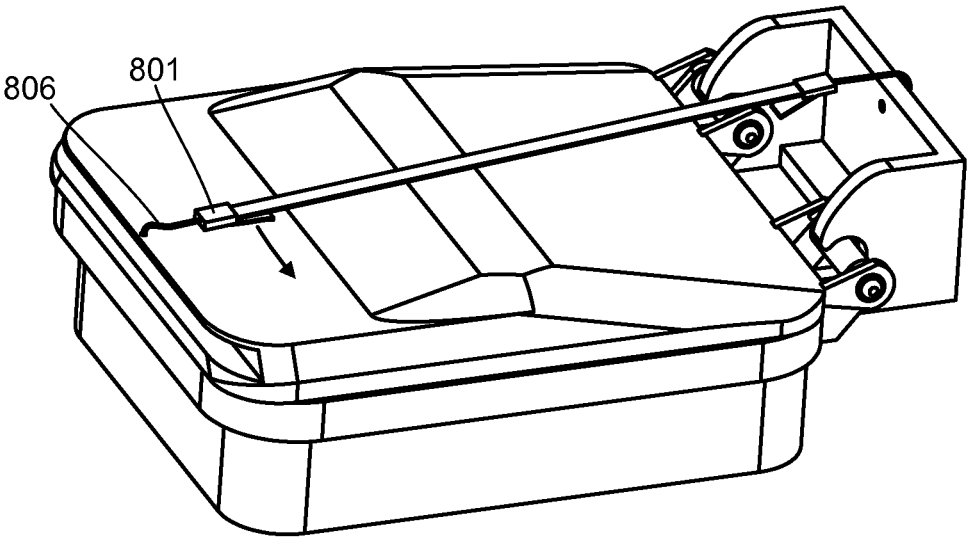
FIG. 8A. illustrates an adjustable tension mechanism embodiment.
Figure 8B:
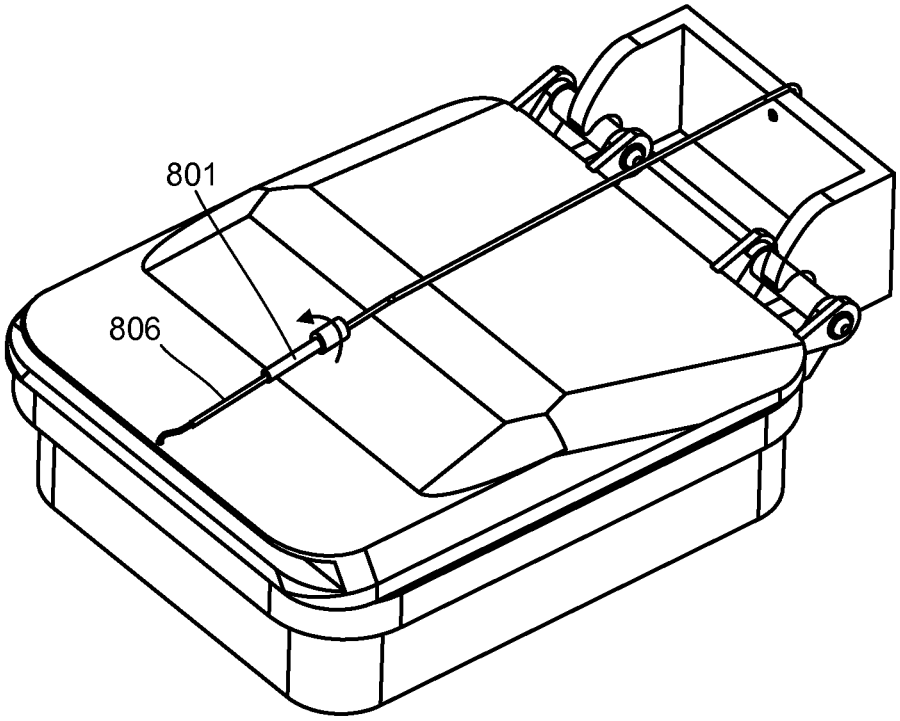
FIG. 8B. illustrates another embodiment of an adjustable tension mechanism.
Figure 8C:
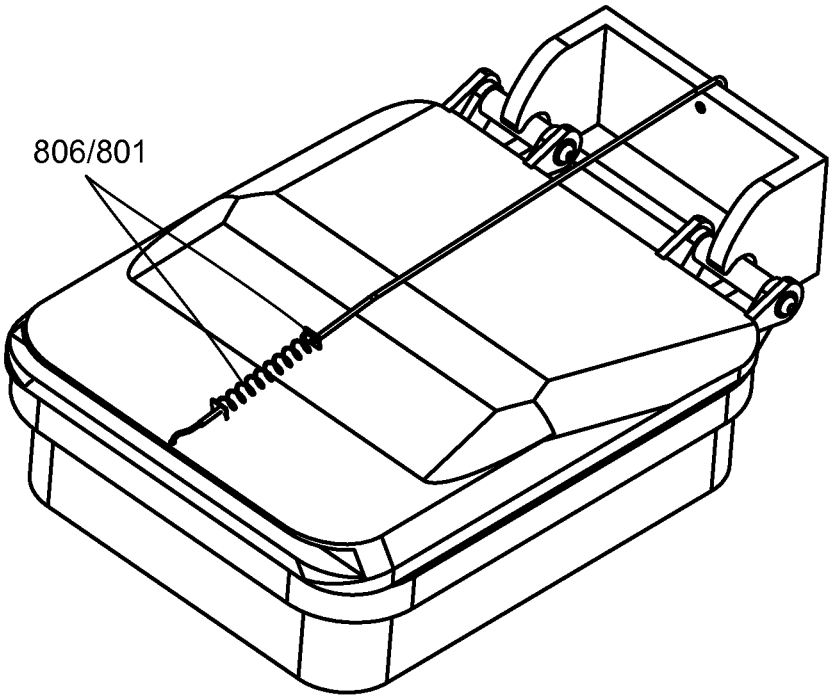
FIG. 8C. illustrates yet another embodiment of an adjustable tension mechanism.

FIG. 8A. illustrates an adjustable tension mechanism embodiment. In an embodiment, the adjustable tension 20 may be an adjustable bungee strap. Adjustable mechanism 801 shows that the adjustable tension 20 may be easily adjusted to allow for optimum operation of a specific cover. Here a user may tighten or loosen the bungee strap by pulling on the strap end (shown with an arrow). FIG. 8B. illustrates another embodiment of an adjustable tension mechanism. In this embodiment, the adjustable tension mechanism 806 may have its tension adjusted via an adjustable mechanism 801 that twists. The twisting of the adjustable mechanism 801 lengthens or shortens the adjustable tension mechanism 806, therefore, changing its tension. FIG. 8C. illustrates yet another embodiment of an adjustable tension mechanism. In this embodiment, the ATM 806 is an adjustable spring. The ends of the spring 801 may be twisted, for example, to change the spring's tension. It should be apparent to one of skill in the art that many various tension mechanism may be used that provide the same purpose, and that various embodiments allow for the adjustable tension 20 to connect to the cover grasper 10 or the anchor 30. The described embodiments or any part(s) or function(s) thereof, may be implemented using customized hardware and parts, off-the-shelf hardware and parts, or any combination thereof. After reading this description, it will become apparent to a person skilled in the relevant art(s) how to implement the embodiments using these combinations.

Figure 9A:
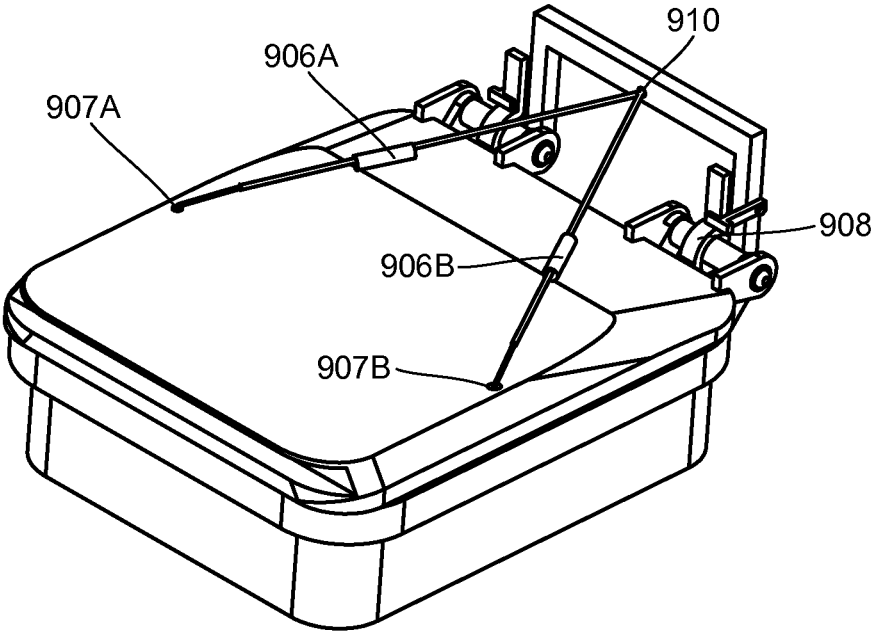
FIG. 9A. illustrates an embodiment of an ATM utilizing more than one ATM.
Figure 9B:
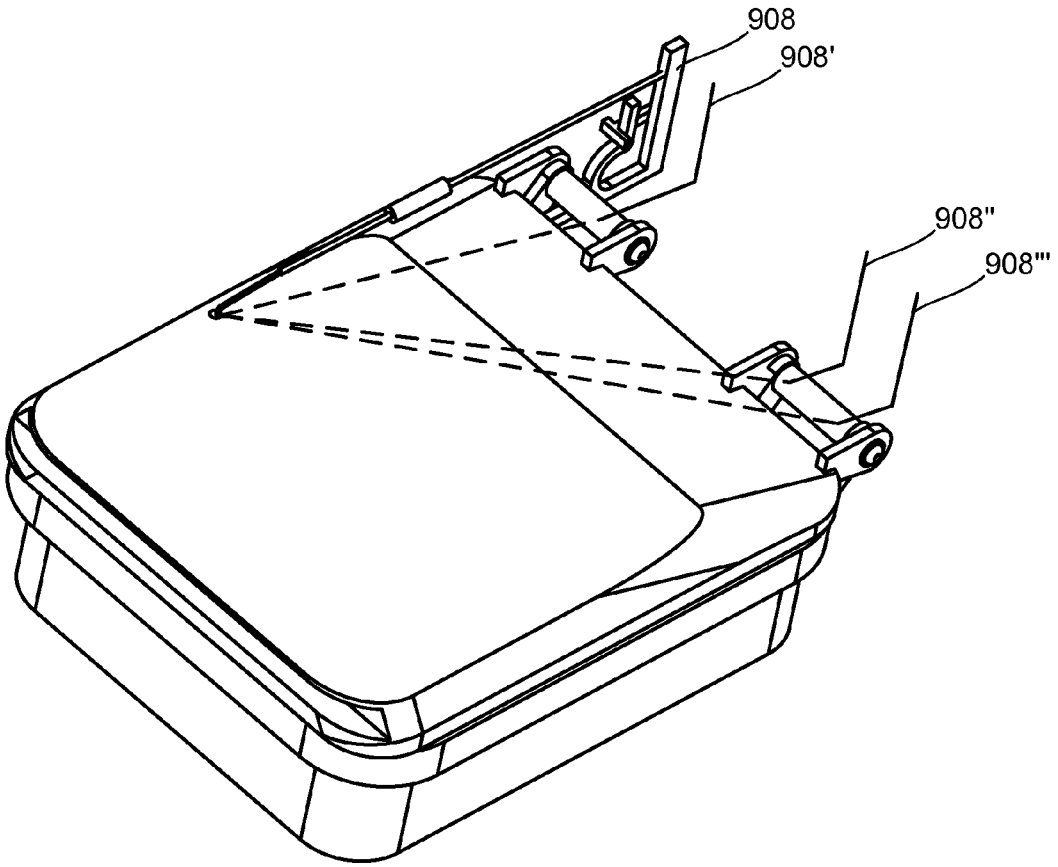
FIG. 9B. illustrates embodiments of an ATM with various placements.

FIG. 9A. illustrates an embodiment of an ATM utilizing more than one ATM. In conjunction, FIG. 9A also illustrates how the cover grasper may connect to different places on the cover and still function properly. Here the cover graspers 907A and 907B are connected in-between the cover's end and its pivot point. ATM 906A and ATM 906B are connected to the anchor 30 and the cover graspers 907A and 907B. Connection point 910 on the anchor 30 is shown to demonstrate how the two ATMs may be connected to the anchor 30, but the two ATMs may be connected in other places on the anchor as well. Also, stabilizer 40 is shown as stabilizing mechanism 908. FIG. 9B. illustrates embodiments of an ATM with various placements. This figure helps demonstrate that the anchor 30 may be connected to the container in a variety of places. The anchor 30 may be off to one side 908, towards the center 908', in the center 910, or on opposite sides 908" and 908'" of the adjustable tension 20.

Figure 10A:
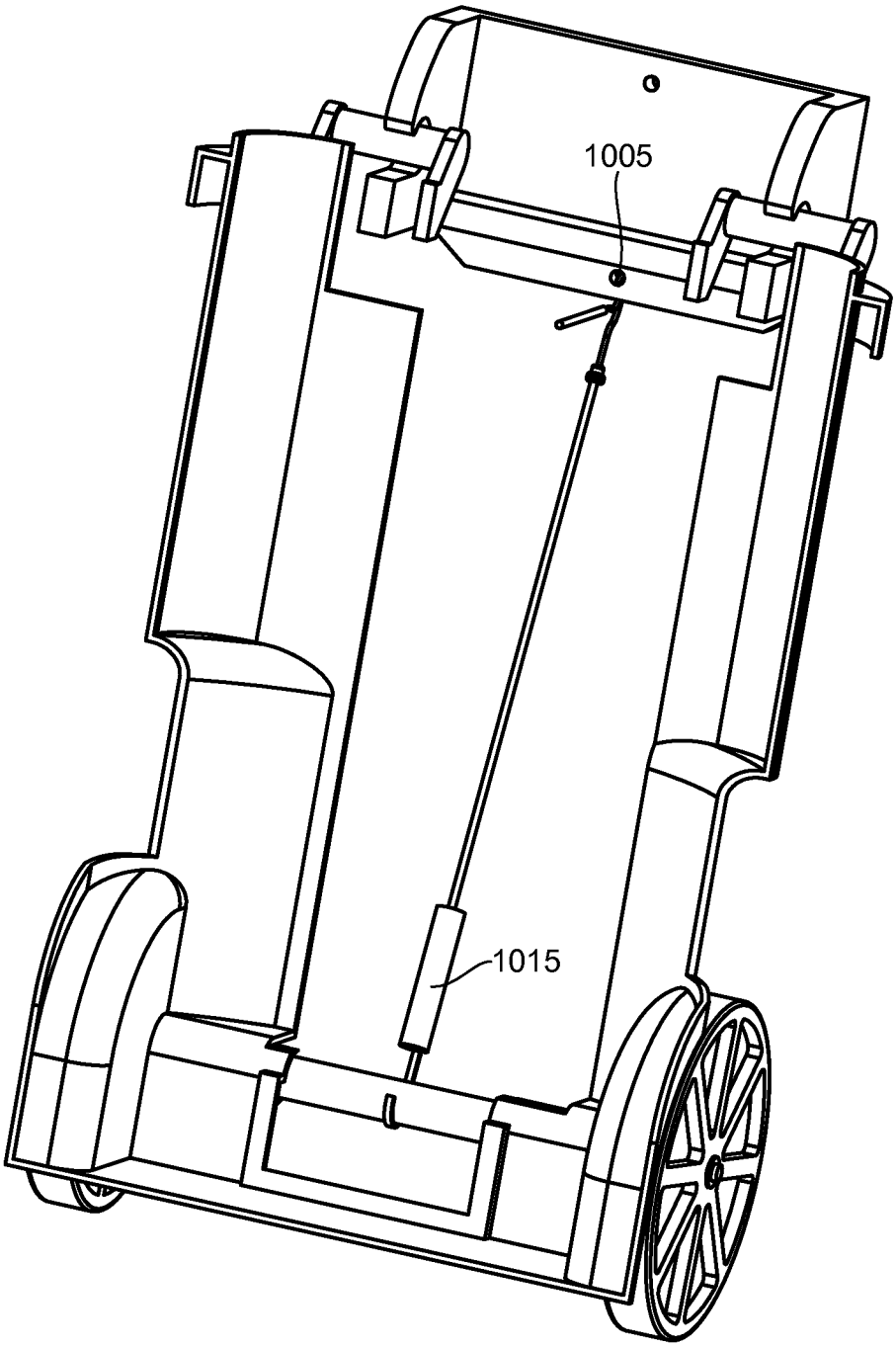
FIG. 10A. illustrates a cut-away view of an embodiment of a stabilizer.
Figure 10B:
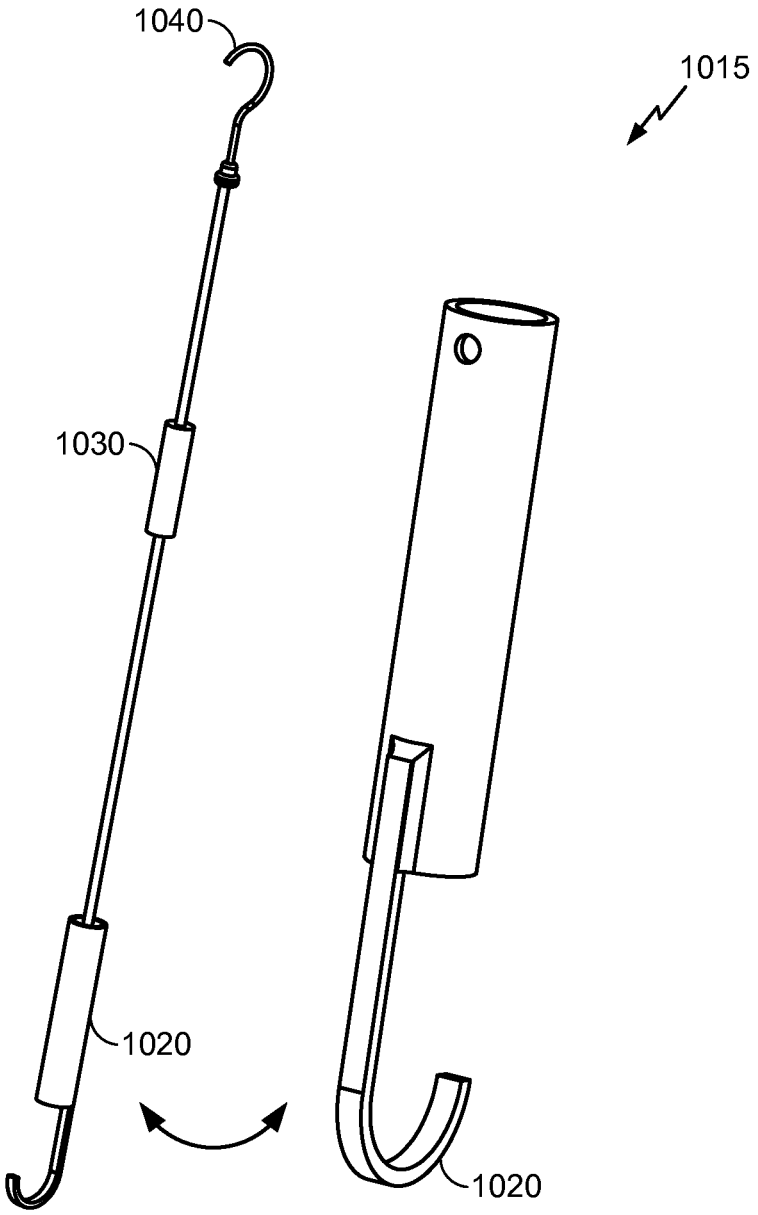
FIG. 10B. illustrates another embodiment of a stabilizer.

FIG. 10A. illustrates a cut-away view of an embodiment of a stabilizer. As mentioned before, the stabilizer may comprise a stabilizing component(s) that prevents the anchor from rotating clockwise, or counter clock-wise. The stabilizer 40 shown here is a separate component from the anchor 30. Stabilizer 1015 is connected between the anchor and the bottom of the container bar, but the stabilizer may be placed in various locations as long as it provides stabilization to the anchor. The stabilizer 1015 is connected 1005 to the anchor 30. FIG. 10B. illustrates another embodiment of a stabilizer 1015. The stabilizer 1015 may have a way of connecting to the anchor 30. Here the connector is shown as an inherent part of the stabilizer 1015 as a hook 1040. However, any variety of embodiments may be used to connect the stabilizer 1015 to the anchor 30. The stabilizer 1015 may be connected to the container bar via a connector 1020 as shown in FIG. 10B. The stabilizer may or may not be under tension 1030. It should be apparent to one of skill in the art that a variety of combinations and embodiments may be used to provide the stabilizing purpose.

Figure 11:
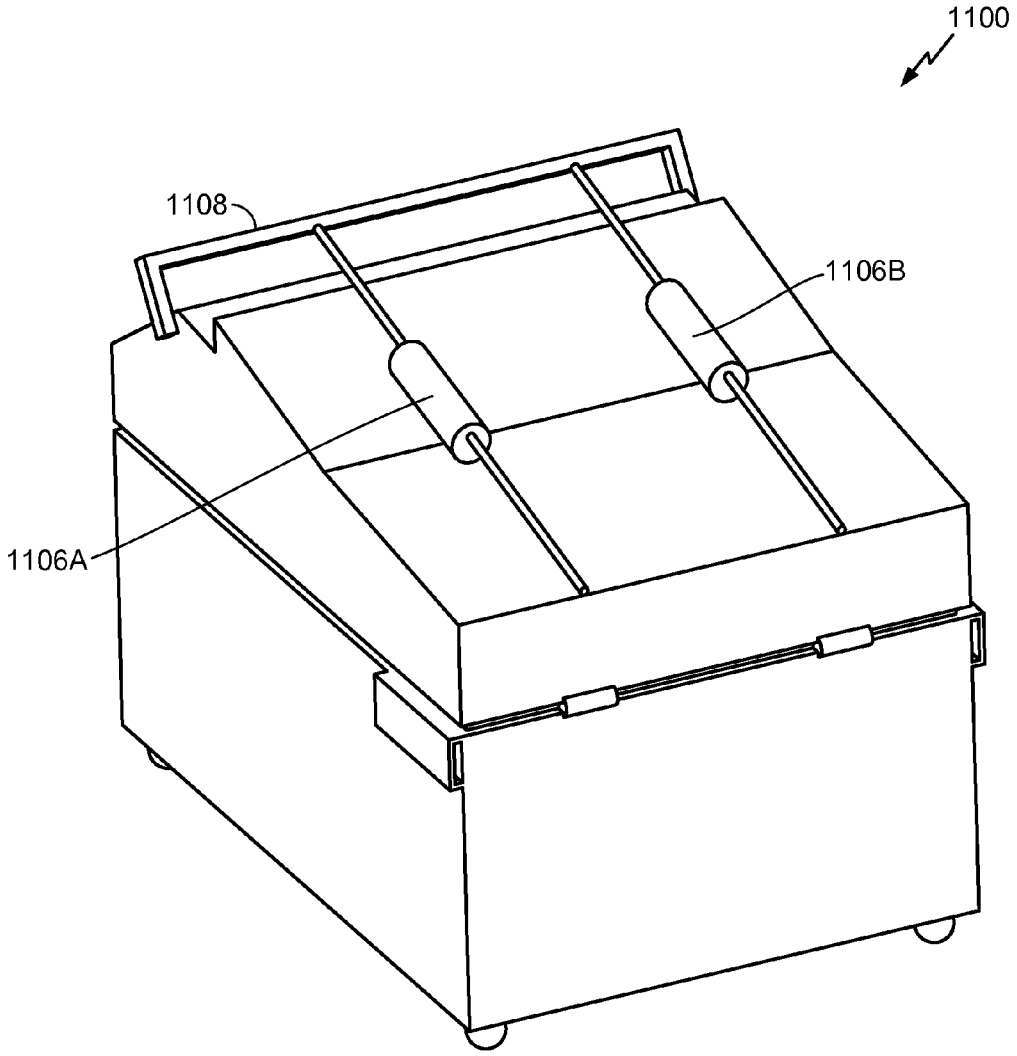
FIG. 11. illustrates embodiments for a commercial container application.

FIG. 11. illustrates embodiments 1100 for a commercial container application. The disclosed embodiments may be used in a variety of applications. FIG. 11 demonstrates how the embodiments may be used on a commercial refuse container. The anchor 30 may be permanently attached to the container if it doesn't interfere with the collection of refuse. Here a "U" shaped bar 1108 may be screwed to the container and provides an anchor 30. ATM 1106A may be associated with one of the commercial container covers, and 1106B may be associated with one of the commercial container other covers.

Figure 12:
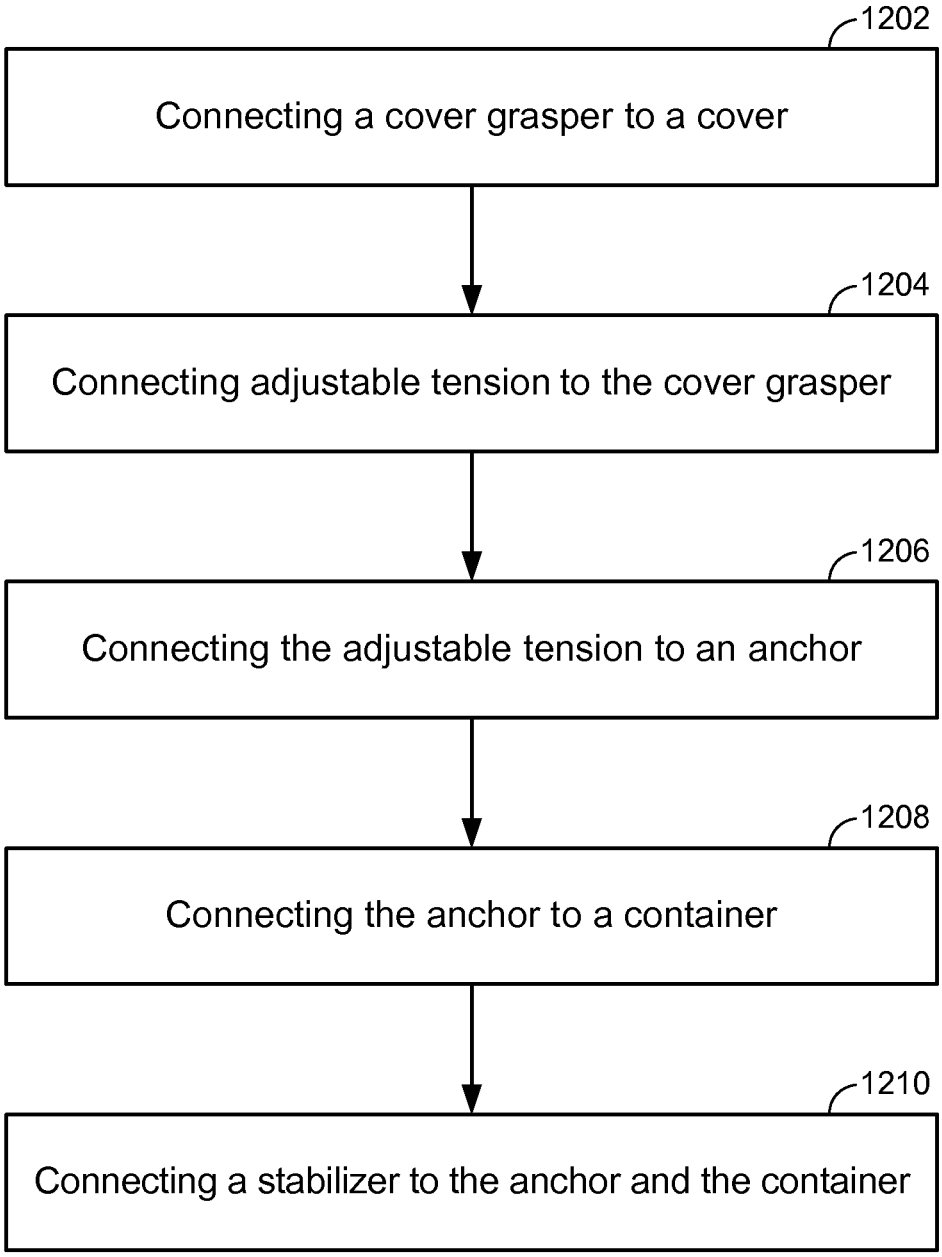
FIG. 12. illustrates a flow chart of an embodiment.

FIG. 12. illustrates a flow chart of an embodiment. A method for conveniently opening and closing a cover begins at step 1202 with connecting a cover grasper to a cover. At step 1204, connecting adjustable tension to the cover grasper. At step 1206 connecting the adjustable tension to an anchor. At step 1208, connecting the anchor to a container, or connecting the anchor off the container elsewhere. And at step 1210, connecting a stabilizer to the anchor and the container, or off the container elsewhere. The embodiments may be described as a process that is depicted as a flowchart, a flow diagram, a structure diagram, or a block diagram. Although a flowchart may describe the operations as a sequential process, many of the operations can be performed in parallel or concurrently. In addition, the order of the operations may be re-arranged. A process is terminated when its operations are completed. A process may correspond to a method, a function, a procedure, a subroutine, a subprogram, etc. For example, the step of connecting the anchor to a container, or connecting the anchor off the container elsewhere, may be done before connecting a cover grasper to a cover.

The foregoing description of the preferred embodiments has been presented for purposes of illustration and description. It is not intended to be exhaustive or to limit the embodiments to the precise form or to exemplary embodiments disclosed. Obviously, many modifications and variations will be apparent to practitioners skilled in this art. Similarly, any process steps described might be interchangeable with other steps in order to achieve the same result. The embodiments were chosen and described in order to best explain the principles of the embodiments and its best mode practical application, thereby to enable others skilled in the art to understand the various embodiments and with various modifications as are suited to the particular use or implementation contemplated. It is intended that the scope of the embodiments be defined by the claims appended hereto and their equivalents. Reference to an element in the singular is not intended to mean "one and only one" unless explicitly so stated, but rather means "one or more." Moreover, no element, component, nor method step in the described disclosure is intended to be dedicated to the public regardless of whether the element, component, or method step is explicitly recited in the following claims. No claim element herein is to be construed under the provisions of 35 U.S.C. Sec. 112, sixth paragraph, unless the element is expressly recited using the phrase "means for . . . . "

It should be understood that the figures illustrated in the attachments, which highlight the functionality and advantages of the described embodiments, are presented for example purposes only. The architecture of the described embodiments are sufficiently flexible and configurable, such that it may be utilized (and navigated) in ways other than that shown in the accompanying figures.

Furthermore, the purpose of the foregoing Abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The Abstract is not intended to be limiting as to the scope of the described embodiments in any way. It is also to be understood that the steps and processes recited in the claims need not be performed in the order presented.

It may be that some of the embodiments that were described as being implemented with hardware, may be available, as technology advances in affordability or functionality, that those embodiments may be implemented using some form of electronics. For example, the ATM's adjustability which has been demonstrated as a mechanical spring function, may have an electronic equivalent. Thus, unforeseen equivalents should not be excluded from the disclosed embodiment(s). A storage medium may represent one or more devices for storing data, including read-only memory (ROM), random access memory (RAM), magnetic disk storage mediums, optical storage mediums, flash memory devices and/or other machine-readable mediums, processor-readable mediums, and/or computer-readable mediums for storing information. The terms "machine-readable medium", "computer-readable medium", and/or "processor-readable medium" may include, but are not limited to non-transitory mediums such as portable or fixed storage devices, optical storage devices, and various other mediums capable of storing, containing or carrying instruction(s) and/or data. Thus, the various methods described herein may be fully or partially implemented by instructions and/or data that may be stored in a "machine-readable medium", "computer-readable medium", and/or "processor-readable medium" and executed by one or more processors, machines and/or devices. Moreover, a micro processor, or similar device may have internal or external memory associated with it.

The various features of the embodiments described herein can be implemented in different systems without departing from the embodiments. It should be noted that the foregoing embodiments are merely examples and are not to be construed as limiting the embodiments. The description of the embodiments is intended to be illustrative, and not to limit the scope of the claims. As such, the described teachings can be readily applied to other types of apparatuses and many alternatives, modifications, and variations will be apparent to those skilled in the art.

What is claimed is:

1. An apparatus for convenient cover opening and closing, comprising:

an anchor comprising:

means for connecting temporarily and securely to a container, wherein the means for connecting to the container comprises at least one hook and is at an opposite end from a cover grasper relative to a cover pivot point;

means for providing a limit stop that prevents a cover from rotating past 135 degrees;

means for connecting to an adjustable tension mechanism (ATM), wherein the means for connecting to the ATM is at a radial distance from the cover pivot point; and means for stabilizing the means for connecting temporarily and securely to the container.

* * * * *